United States Patent [19]

Duval

[11] 4,187,625

[45] Feb. 12, 1980

[54] SYSTEM FOR EXCAVATION AT SEA THROUGH HORIZONTAL GUIDING BY MEANS OF CABLES

[75] Inventor: Jean J. Duval, Paris, France

[73] Assignee: Compagnie Francaise des Petroles, Paris, France

[21] Appl. No.: 888,448

[22] Filed: Mar. 20, 1978

[30] Foreign Application Priority Data

Mar. 21, 1977 [FR] France ..... 77 08421
Mar. 1, 1978 [FR] France ..... 78 05832

[51] Int. Cl.[2] ..... E02F 3/44

[52] U.S. Cl. ..... 37/71; 37/117; 37/183 R

[58] Field of Search ..... 37/54, 71, 115, 117, 37/183 A, 183 R, 184–188, 73

[56] References Cited

U.S. PATENT DOCUMENTS

| | | | |
|---|---|---|---|
| 1,034,501 | 8/1912 | Peterson | 37/115 UX |
| 1,691,513 | 11/1928 | Burkett | 37/115 UX |
| 2,410,765 | 11/1946 | Von Hagen | 37/71 UX |
| 2,496,101 | 1/1950 | Massey | 37/71 |
| 2,864,182 | 12/1958 | Russell | 37/71 UX |
| 2,933,837 | 4/1960 | Nelson | 37/72 X |
| 2,996,819 | 8/1961 | Bowman et al. | 37/184 |
| 3,365,823 | 1/1968 | Vogt | 37/71 |
| 3,763,580 | 10/1973 | Kuntz, Jr. | 37/65 X |
| 3,949,496 | 4/1976 | DeKoning et al. | 37/72 X |

*Primary Examiner*—Clifford D. Crowder
*Attorney, Agent, or Firm*—Sughrue, Rothwell, Mion, Zinn and Macpeak

[57] ABSTRACT

An underwater excavation system comprises an excavating implement suspended from a surface support by a carrying line and means for moving the implement horizontally between an excavation site and a spoil dumping site comprising a guide line cooperating with the carrying line and extending from the surface support to a mooring on the sea bed.

21 Claims, 8 Drawing Figures

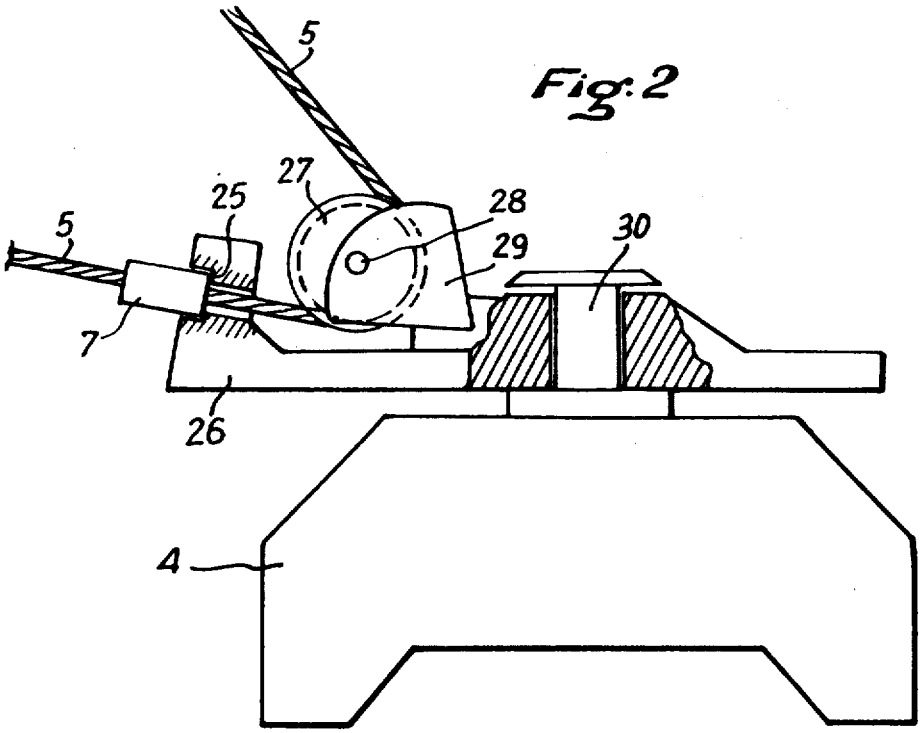
Fig. 2
Fig. 3
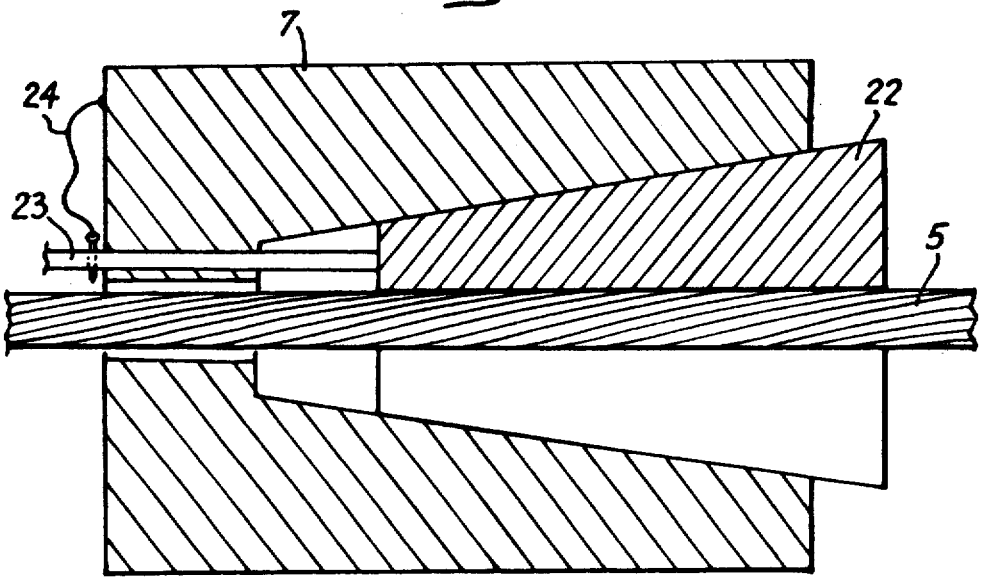

SYSTEM FOR EXCAVATION AT SEA THROUGH HORIZONTAL GUIDING BY MEANS OF CABLES

BACKGROUND OF THE INVENTION

The invention relates to an excavation system using a grab guided near the area to be excavated.

Accurate guiding of the grab used in an excavating system becomes necessary when it is required to excavate the sea bottom and dump the spoil at a particular place. It is of course conventional to lower any system, tool well heads or the like to an exact spot, by vertical guiding using a number of lines secured between the seabed and a surface station. However, it has been found by experience that at least two cables close to one another are required for vertical guiding, very often with considerable risk of the lines becoming entangled. Automatic locating means are known but are highly complex and wholly unsuitable for controlling a grab.

SUMMARY OF THE INVENTION

It is an object of the invention to provide an underwater excavation system comprising:

- an excavation implement;
- a carrying line therefor;
- means connecting said excavation means to said carrying line;
- a support station;
- lifting means on the support station controlling the length of the carrying line;
- at least one guide line means;
- connecting means connecting the guide line means to the carrying line,
- fixed position means located near the area to be excavated, and
- a winch for the guide line means,
- change of position of the guide line means being by control of the distance of the connecting means from the fixed position means by the winches controlling the lengths of the lines.

To increase the accuracy of shaping of the excavation and of the spoil-dumping zone two guidelines may be provided each carrying a stop, whose position is adjustable, to limit oscillation of the implement under the tension of the two guidelines. Upon abutment of each stop with a fixed position means associated with each guide line, each stop provides an accurate location of the implement, the tension in the guide lines being maintained constant by any known means such as constant-tension winches.

Consequently, when each of the guidelines is tensioned sufficiently to make the stops abut the fixed position means, the excavating implement is positioned correctly for operation. The excavation can therefore readily be given any required shape by altering the position of the stops.

The guidelines are preferably connected to winches on a support station. To ensure the accuracy of the shaping of the excavation using abutment of the stops against the fixed position means, irrespective of the effects of any sea swell on the surface station, the guidelines are advantageously associated with means for compensating for any vertical movements of the surface station. The horizontal position of the excavating implement can thus always be accurately adjusted despite any pitching or rolling or vertical movements of the surface station.

When the system is not in use, the guidelines are preferably detached from the guide means and attached to auxiliary winches adjacent the winch for the carrying line and on the support station. This facilitates adjustment of the positions of the stops on the guidelines.

Another advantage of providing an auxiliary winch near the winch for the implement-carrying line is that it facilitates the positioning of the fixed position means at the required places on the ground. With the stop abutting the fixed position means, the control winch is operated to lower the guideline, the fixed position means and stop, the auxiliary winch also unwinding that part of the guideline wound thereon. Once the fixed position means is in the selected position, the support station is adjusted so that the winch for the carrying line for the implement is vertically above the spoil-dumping zone. The auxiliary winch is then operated to bring the stop back to the surface so that its position on the guideline can be adjusted to the required distance from the guide means. Thereafter the end of the guideline is secured to the guide means on the carrying line. Excavation can then begin.

Consequently, using just two guidelines for guiding the implement-carrying line, it is possible to lower the fixed position means to the required positions and to determine the exact distance between the grab-carrying line and the two fixed position means so that excavation can begin, to move the implement to the spoil-dumping position the two guidelines are released.

Another advantage is that the implement can be positioned accurately without any need to synchronize movements of the guidelines, the winches of which can be operated independently of one another.

A final advantage is that the operation of bringing the guidelines to the surface so that the positions of the stops can be adjusted and of bringing the fixed position means to the surface upon completion of excavation, are operations which can be carried out as readily as the installation operations.

BRIEF DESCRIPTION OF THE DRAWINGS

The invention will be more fully understood from the following description of an embodiment thereof, given by way of example only, with reference to the accompanying drawings.

In the drawings:

FIG. 2 is a diagrammatic view in elevation and partly sectioned of a moving means used in the system of FIG. 1;

FIG. 3 is an enlarged diagrammatic view, partly in section, of a stop or abutment and of the means for securing the same used in the system of FIG. 1;

DETAILED DESCRIPTION OF THE PREFERRED EMBODIMENTS

Figure 1:
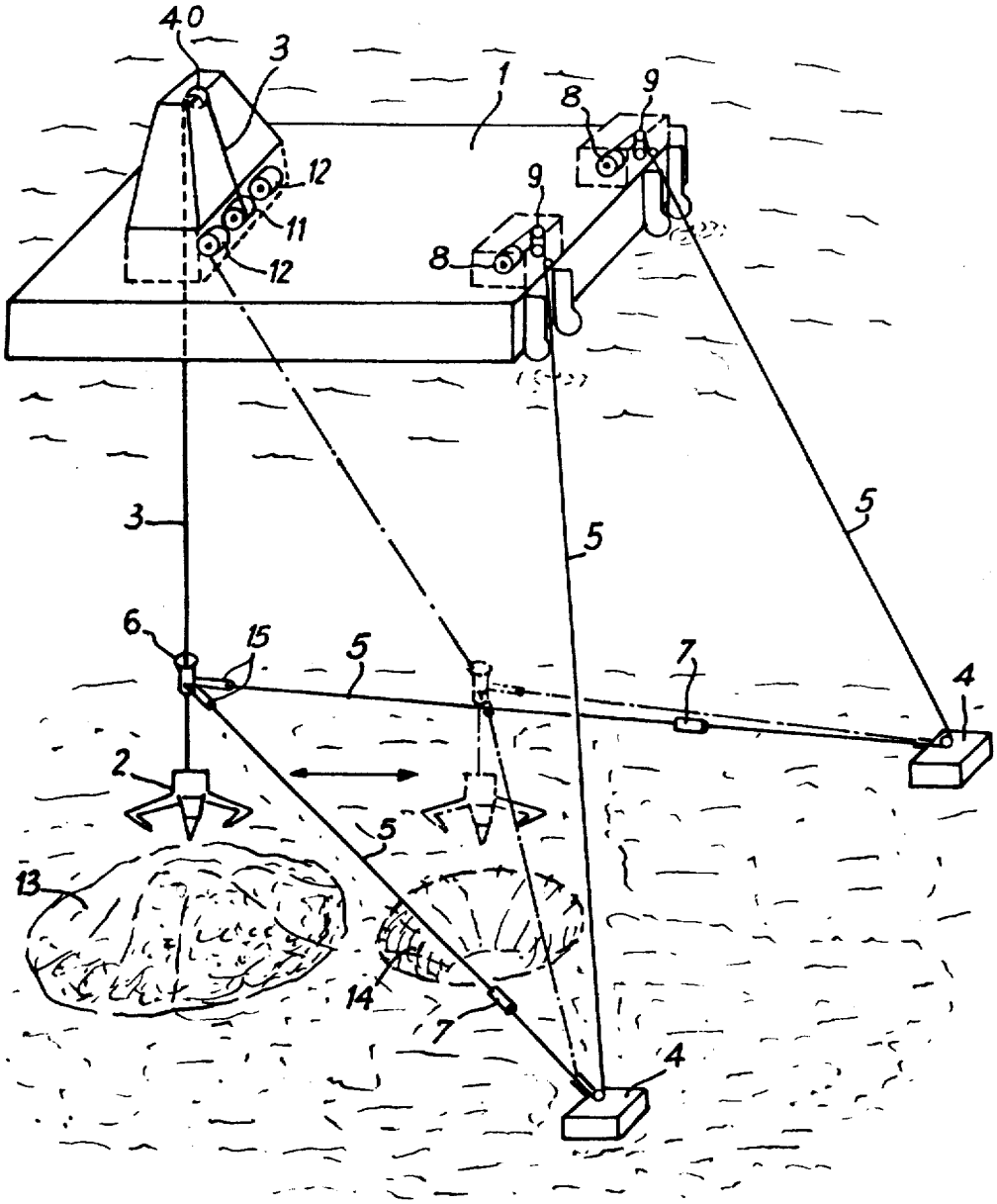
FIG. 1 is a diagrammatic and perspective view of an embodiment of an excavation system according to the invention.
Figure 6:
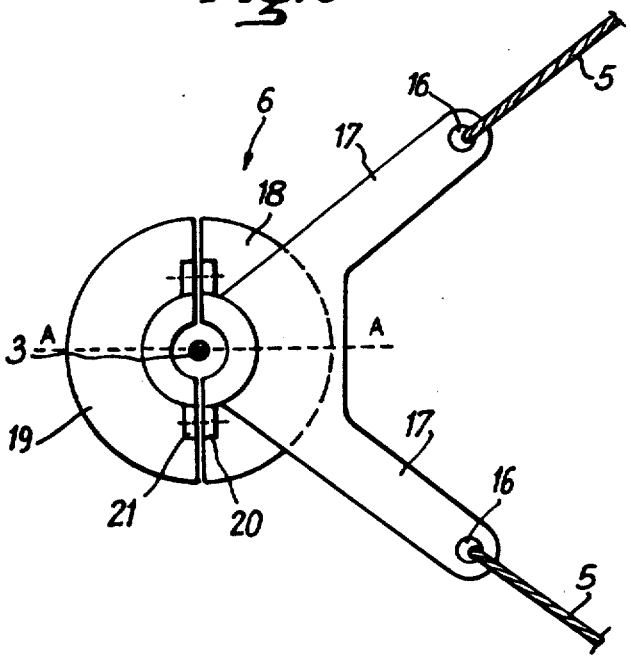
FIG. 6 is a plan view of the means for guiding the grab-carrying line.
Figure 7:
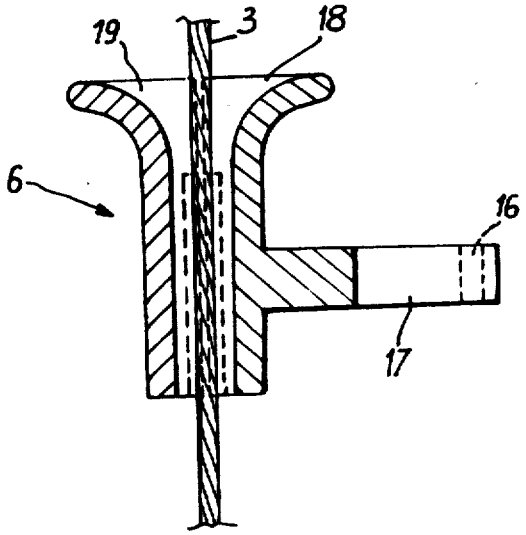
FIG. 7, is a section on the line A—A of FIG. 6.

In FIG. 1 there is shown a support station 1 which can be of any kind and is arranged so that a grab 2 carried on a carrying line 3 wound on a winch 11 on the station is vertically above a spoil dumping zone 13. Mooring means 4 are placed on the seabed at positions far enough apart from one another for excavation to be carried out within the required dimensions. To position the grab 2 vertically above a place 14 selected for excavation the line 3 passes through a guide device 6 connected to lines 5 which run therefrom to moorings 4 and to winches 8 on the surface support. Winding up of the lines 5 thus pull the device 6 and the grab 2 across to the excavation site. Stops 7 disposed on parts of lines 5 which extend between the moorings 4 and line ends 15 are positioned so as to abut on the moorings when the grab is in the required position. The line ends 15 are secured by any known means, such as hooks or shackles or the like, to the ends 16 (FIG. 7) of arms 17 of the guide device 6 (FIGS. 6 and 7) of the carrying line 3. The device 6 can comprise two parts—a part 18 comprising arms 17, and a part 19 of any shape. The line 3 is clamped between the two parts 18, 19, which are assembled together by any suitable means, such as bolts and nuts (not shown), by engaging together side flanges 20, 21 of the two parts 18, 19. Each part 18, 19 is flared at its upper end so as to provide progressive guidance of the top part of line 3 as it changes direction when pulled away from its vertical position by the lines 5, as shown in FIG. 1 by chain-dotted lines which represent the grab 2 when it is vertically above the excavation zone 14.

The stop or abutment 7 comprises means 22 (FIG. 3) for securing it to the line 5. In the example shown, the means 22 can be considered to take the form of an ordinary wedge for clamping the line 5 to the body of the stop. The means 22 can alternatively be of any kind. The wedge 22 has been shown diagrammatically in association with retaining and clamping means 23 and some form of connection 24 symbolizing the locking of the means 22.

The stop or abutment 7 can be of any shape and is shown in FIG. 2 as having a simple rectangular section adapted to abut the base of a recess 25 in an arm 26 carrying a pulley 27. Spindle 28 of the pulley 27 is mounted in cheeks 29. Arm 26 pivots around a pin 30 rigidly secured to the mooring 4.

Figure 4:
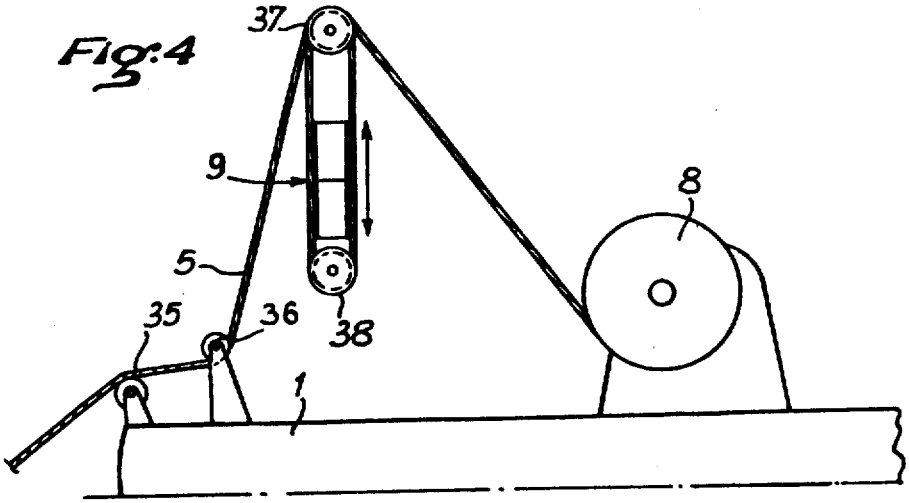
FIG. 4 is a diagrammatic view of a vertical motion compensating means used in the system of FIG. 1.
Figure 5:
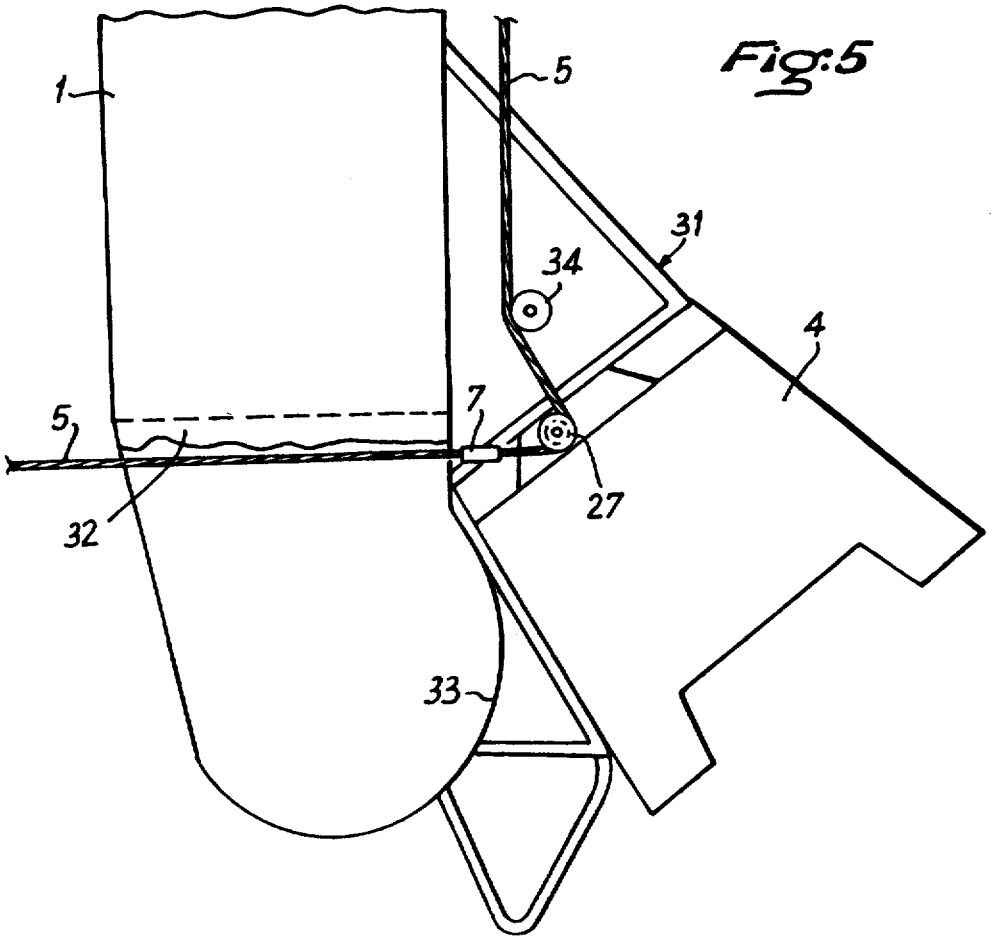
FIG. 5 is a diagrammatic view in side elevation of the moving means in its raised position on board a support station.

When the mooring 4 is on board the surface station 1, it is held on a cradle 31 which can be seen in FIG. 5. That part of the support station 1 which is below the break-away line 32 is similar to the support station part 33 carrying the bottom part of the cradle 31. The reason for the illustration being broken away below the line 32 is to show how the line 5 extends below the support station 1. In this position of the mooring the end 15 of the line 5 is connected not to one of the arms 17 of the device 6 but to winches 12, and the line extends via the access way in the station 1 for the carrying line 3. The other end of the line 5 is connected to the winch 8 (FIGS. 1, 4) and the corresponding run of line 5 from the pulley 27 to the winch 8 goes over guide pulleys 34 to 36 before being operatively associated with a vertical motion compensating system 9, shown diagrammatically in the form of two pulleys 37, 38 whose spacing can be varied by any appropriate intermediate means. Systems of this kind are well known and so will not be described in detail. An identical system is used for the second line 5.

Once the surface station 1 has been brought to the place where excavation is required with its lines 5 in the position shown in FIG. 5, the support station 1 is anchored so that one of the moorings 4 is in a position vertically above its required seabed position. Since a sufficient length of the line 5 has been wound on the winch 12 at the line end 15, unwinding the winch 8 and detensioning the run connected to the winch 12 are sufficient to lower the mooring 4 vertically to its required position, the stop 7 retaining the mooring 4 relative to line 5 until it rests on the seabed. The second mooring 4 is positioned in the same way.

Once the moorings 4 are in the selected positions, the support station 1 is moved so that reversing pulley 40 of the carrying line 3 is vertically above the spoil-dumping zone 13. The stops 7 are then winched to the surface by means of the winches 12, with unwinding of the lines 5 from the winches 8, and the positions of the stops 7 on the lines 5 are adjusted as required. The wedges 22 are slackened so that the stops 7 can be slid on the lines 5, the stops 7 being resecured thereto when each stop is at the required distance from the end 15 of its corresponding cable. So that excavation may begin, each winch 12 is unwound and the ends 15 of lines 5 are secured to the device 6, whereafter the device 6 is secured to the carrying line 3 far enough away from the grab 2 for the device 6 to be above the level of the ground being excavated even when the grab 2 reaches the selected excavation depth. Preferably, therefore, the distance between the grab 2 and the device 6 is at least equal to the required excavation depth. This is the case shown in FIG. 1. When the constant-tension winches are operated as required, either independently or simultaneously, the grab 2 can be brought vertically above the excavation 14, the position of the grab being defined by the position of the stops 7 along the lines 5. The winch 11 is then operated to lower the grab 2, the control and drive means of which can be of any kind and operated e.g. by way of the line 3 which carries the grab 2 and supplies electric power thereto. The spoil can be dumped either vertically below the reversing pulley 40 after unwinding of the winches 8 or near this position as a result of the grab opening during its return movement towards the spoil-dumping zone 13.

The excavation zone 14 remains accurately located despite pitching and rolling, since the position of the device 6 depends only upon the positions of the moorings 4 and the stops 7, which remain in contact therewith during excavation, whatever the lengths of the runs of the lines 5 between the moorings 4 and the systems 9 may be.

The invention is not limited to the embodiment hereinbefore described but covers any system consisting of equivalent means. For example, a pump dredger or any other means could be used instead of the grab.

The above described system has many advantages. The only equipment required for the support station is control means for the line which carries the grab and through which electricity is supplied thereto and for the lines for adjusting the horizontal position of the grab. The support station can therefore be a relatively lightweight device as compared with the support stations used for drilling. Adjustment of the grab position depends solely upon the pull of the guide lines, the excavation can be variable and, depending upon the nature of the seabed, the grab can readily be replaced by a pump dredger.

The fixed positions around which the lines connected to the guide means guiding the grab-carrying line are guided can be ordinary moorings which can be spaced apart from one another as required to suit a desired width of excavation. Once the pull on the guidelines causes, the grab can return to a position which is vertically below its control winch and which is the spoil-dumping position.

Figure 8:
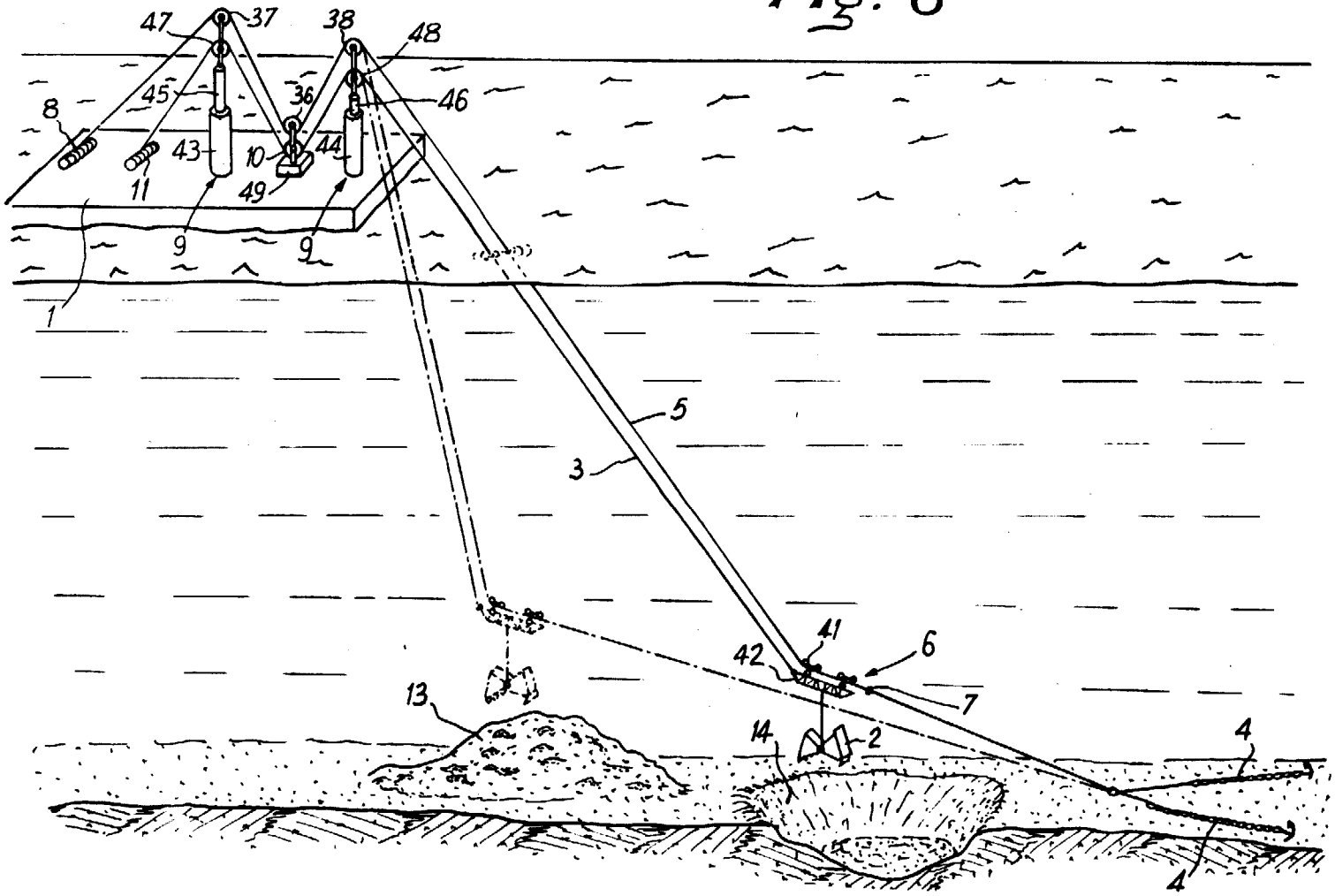
FIG. 8 is a schematic perspective view of another embodiment according to the invention.

Referring now to FIG. 8, a support station 1, is equipped with winches 11 and 8 for controlling respectively the length of a carrying line 3 and a guide line 5. The winches 8 and 11 are located near one another and guide pullies 10 and 36 for these lines are mounted one below the other on a common support 49 fast with the deck of the support station 1 in order to keep the lines 3 and 5 in the same vertical plane. To ensure good positioning of line 5 on the seabed, this line includes two anchors 4 whose distance from an excavation site 14 is sufficiently great that the part of line 5 between coupling means 6 coupling the part of line 3 carrying grab 2 to the guide line 5 and the anchors 4 is nearly horizontal. This arrangement is most advantageous as the tensile forces on the guide line 5 tend to ensure a better anchorage.

The means 6 coupling grab carrying line 3 to the guide line 5 comprises a trolley 42 fixed to line 3 and a pulley assembly 41 whose axes are fast with the trolley. These pulleys ensure the coupling of carrying line 3 to the guide line 5 and allow, as a function of the lengths of the lines 3 and 5 controlled by their corresponding winches 11 and 8, the grab 2 to be moved from a position relative to the zone 14 in the course of excavation to the zone 13 for dumping the spoil dug up by the grab. The movement of the coupling means towards the anchors 4 can be limited by means of a stop 7.

The means 9 for compensating for vertical motion preferably comprise two jacks 43 and 44 aligned with the guide pulleys 10 and 36, jack 43 being between the winch 11 and the support 49 for the guide pulleys, the jack 44 being between the support 49 and the extremity of the support station 1. The jacks 43 and 44 through their rods 45 and 46 support pairs of pulleys 37, 47 and 38, 48, the pulleys 37 and 38 supporting the guide line 5, the pulleys 47 and 48, supporting the carrying line 3. The jack 44 is operable to apply a predetermined minimum tension to the lines 3 and 5, for example of the order of 15 tons, the jack 43 being operable to apply to the lines a greater tension, for example of the order of 80 tons.

When the length of the lines are set to position the grab 2 above the excavation site with the coupling means 6 abutting the stop 7, it is not necessary to apply a supplementary tension to the lines. In these circumstances, the rods 45, 46 of jacks 43, 44 are positioned in their respective idle positions, that is to say the rod 46 is withdrawn, the pulleys 38 and 48 thus being in their lowest position, and the rod 45 is extended so that the pulleys 37 and 47 are in their highest position.

When the grab is lowered so that it contacts the part to be excavated, the lines 3, 5 are tensioned by operating the jack 44 whose rod 46 pushes pulleys 38, 48 upward. The tension on line 5 is then, in the example considered, at least equal to a predetermined value, of 15 tons for example.

Raising of the loaded grab is effected by using jack 43 and by returning rod 46 of jack 44 to its initial rest position, that is to say by retracting rod 46. The pulleys 37 and 47 are thus subject to the tension in the lines and the maximum pressure adopted for jack 43.

After setting the winches 8 and 11 to bring the coupling means 6 and hence the grab 2 above the dumping zone 13, and then after dumping the spoil brought by the grab, the jacks 43 and 44 can again be stopped, the rod 46 of the jack 44 being returned to the withdrawn position and the rod 45 of the jack 43 being returned to the extended position.

It is clearly within the scope of the invention to use other means for compensating for vertical movement and to use another form of grab and any coupling means equivalent to those described. A jack could be added to the means 42 to vary its distance from the stop 7 by control of the extension of the rod of the jack of which the extremity abuts the stop 7. This arrangement would avoid the need to raise the line 5 to vary the position of the stop.

What is claimed is:

1. An underwater excavation system comprising:

(a) an excavation means;

(b) a carrying line therefor;

(c) means connecting said excavation means to said carrying line;

(d) a support station on the surface fixed in a position generally above a dumping site on the seabed;

(e) lifting means mounted on the support station for controlling the length of the carrying line;

(f) at least one guide line;

(g) connecting means fixedly connecting the guide line to said carrying line, (h) fixed position means located on the seabed near the site to be excavated, (i) a winch for the guide line mounted on the support station, and (j) sheave means mounted on the fixed position means through which the guide line passes to run from the connecting means to the guide line winch, (k) whereby the guide line is winched in to position the excavation means above the excavation site, and slackened to allow the excavation means to gravationally swing over to the dumping site.

2. A system according to claim 1 wherein the excavation means is a grab and said guide line is connected to said carrying line at a point spaced from said grab by a distance at least equal to the required depth of the excavation.

3. A system according to claim 1, wherein there are two fixed position means and two guide lines, each guide line running through a respective fixed position means on the seadbed, and an adjustable stop on each guide line for abutment with means at said fixed position means to limit the travel of the guide lines.

4. A system according to claim 3, wherein each fixed position means comprises a mooring having an orientable pulley.

5. A system according to claim 4, wherein each mooring comprises an orientable arm provided with a recess for receiving the associated one of said stops.

6. A system according to claim 3, wherein each stop is slidable on its associated guide line between said fixed position means and said connecting means.

7. A system according to claim 3, wherein the connecting means for said carrying line comprises a member having two arms to which said guide lines are respectively secured, means for clamping said carrying line, and a flared upper mouth.

8. A system according to claim 3, wherein said stops are positioned on said guide lines such that said excavating means is located at the excavation site when said stops abut said means at said fixed position means.

9. A system according to claim 1, wherein each of said guide lines is connected to a constant tension winch.

10. A system according to claim 1, wherein said guide line extends from said fixed position means to vertical motion compensating means disposed on the support station.

11. A system according to claim 10, in which the fixed position means may be retained in position on said support station by a cradle and the associated guide line, one end of which extends to a constant tension winch, the other end extending via an access way for said carrying line to a second winch.

12. An underwater excavation system comprising:

(a) an excavation implement;

(b) a carrying line to which the implement is secured;

(c) a guide line for the carrying line;

(d) connection means slidably coupling the carrying line to the guide line;

(e) fixed point positioning means on the seabed securing one end of the guide line;

(f) a support station on the surface fixed in a position proximate a dumping site on the seabed;

(g) separate control winches for individually handling the carrying line and guide line mounted on the support station, (h) the carrying line and guide line extending over the same side of the support station and in a common vertical plane, and (i) a stop fixed to the guide line at a point spaced from the fixed positioning means and proximate an excavation site for limiting the travel of the connection means, (j) whereby the carrying line is slackened to gravationally transport the implement to the excavation site, and the guide line is slackened to gravationally transport the implement to the dumping site.

13. A system according to claim 12 the fixed point positioning means comprises two anchors one on either side of the said vertical plane.

14. A system according to claim 12 wherein the connection means comprises a trolley fixed to the carrying line and pulleys running on the guide line and mounted on the trolley.

15. A system according to claim 12 further comprising means for compensating for vertical movement of the support station including jacks carrying pairs of pulleys over which the guide line and the carrying line run.

16. A system according to claim 15 in which one jack applies a minimum tension to the carrying line and guide line and the other jack applies a maximum tension thereto.

17. A system according to claim 16 in which the jack which applies maximum tension is extended when in an idle condition, the lengths of the carrying line and the guide line between the two jacks run through guide pulleys mounted on a fixed support on the support station, and the winches for controlling the lengths of the carrying line and the guide line effect the displacement of the implement to the dumping site.

18. A system according to claim 16 wherein the jack which applies minimum tension is extended during excavation.

19. A system according to claim 16 wherein the jack applying minimum tension is in the retracted condition when the jack is idle, and the jack applying maximum tension is extended to displace the carrying line and the guide line when the implement is loaded.

20. An underwater excavation system comprising:

(a) a surface station fixed in a position generally above a dumping site on the seabed;

(b) an excavating implement;

(c) a carrying line therefor extending from said surface station;

(d) a carrying line winch mounted on said surface station;

(e) means connecting said excavating implement to said carrying line and connecting said carrying line to said winch;

(f) guide means on said carrying line for moving said excavating implement horizontally;

(g) two mooring means located on the seabed adjacent an excavation site;

(h) two guide lines connected to said guide means and extending therefrom to said surface support each via a respective one of said mooring means;

(i) guide line winches on said surface station for individually handling each guide line; and (j) means connecting said guide lines to the respective guide line winch means.

21. A system as claimed in claim 20, comprising stop means carried by each of said guide lines for abutment with its associated mooring means when said guide means is displaced from a position in which said carrying line is vertical.

* * * * *